US006152236A

United States Patent [19]

Retzloff et al.

[11] Patent Number: 6,152,236

[45] Date of Patent: Nov. 28, 2000

[54] COMBINED TRIGGER AND CONCEALING DEVICE FOR A SPRINKLER HEAD

[75] Inventors: James G. Retzloff, Lansing; Thomas E. Winebrenner; Scott T. Franson, both of Hastings, all of Mich.

[73] Assignee: The Viking Corporation, Hastings, Mich.

[21] Appl. No.: 09/166,518

[22] Filed: Oct. 5, 1998

[51] Int. Cl.[7] ..... A62C 37/12

[52] U.S. Cl. ..... 169/57; 169/19; 169/37; 169/38; 169/39; 169/42; 169/56

[58] Field of Search ..... 169/19, 37, 38, 169/39, 42, 56, 57

[56] References Cited

U.S. PATENT DOCUMENTS

| | | | |
|---|---|---|---|
| 399,521 | 3/1889 | Grinnell . | |
| 2,591,872 | 4/1952 | Rider | 169/42 X |
| 3,061,016 | 10/1962 | Hodgman, Jr. | 169/42 |
| 3,195,647 | 7/1965 | Campbell et al. | 169/37 X |
| 3,459,266 | 8/1969 | Ault | 169/37 |
| 3,783,947 | 1/1974 | Dix et al. | 169/40 |
| 4,214,631 | 7/1980 | Hattori | 169/57 |
| 4,217,960 | 8/1980 | Miyazaki | 169/38 |
| 4,596,289 | 6/1986 | Johnson | 169/37 |
| 4,651,832 | 3/1987 | Kubo | 169/39 |
| 4,660,648 | 4/1987 | Zen | 169/38 |
| 4,880,063 | 11/1989 | Leininger et al. | 169/37 |
| 4,977,963 | 12/1990 | Simons | 169/37 |
| 5,117,916 | 6/1992 | Ohta et al. | 169/37 |
| 5,447,338 | 9/1995 | Kikuchi | 169/37 X |
| 5,497,834 | 3/1996 | Onuki | 169/37 |

OTHER PUBLICATIONS

A copy of the Technical Data Sheets detailing The Viking Corporation's Horizon ® Model H Standard Response Flush Pendent Sprinkler, Nov. 7, 1996.

A copy of the Technical Data Sheets detailing The Viking Corporation's Horizon ® Model H Quick Response Flush Pendent Sprinkler, Dec. 16, 1996.

*Primary Examiner*—Andres Kashnikow
*Assistant Examiner*—Robin O. Evans
*Attorney, Agent, or Firm*—Van Dyke, Gardner, Linn & Burkhart, LLP

[57] ABSTRACT

A combined trigger and concealing device for an automatic sprinkler head comprises a first plate attached to a second plate by a heat fusible material in a partially overlapping manner. Each plate is formed with an aperture which receives an actuator depending from the bottom of the sprinkler head. The trigger device depends a preselected distance from the bottom of the sprinkler head body and has an outer dimension which causes the trigger device to conceal the internal components of the sprinkler head from view. An annulus defined between the periphery of the device and the bottom of the sprinkler head permits heat energy to be received by the inner surface of the trigger device. Conduction of heat energy from both the inner and outer surface of the trigger device permits the heat fusible material to be expeditiously raised to the preselected separation temperature. This uniform thermal conduction minimizes the response time of the automatic sprinkler head while maintaining a highly aesthetic appearance.

32 Claims, 2 Drawing Sheets

COMBINED TRIGGER AND CONCEALING DEVICE FOR A SPRINKLER HEAD

BACKGROUND OF THE INVENTION

The present invention relates to sprinkler heads used in automatic fire extinguishing systems for buildings and the like, and in particular, relates to automatic sprinkler heads having a triggering element used to initiate opening of the fluid flow orifice of the sprinkler head.

Sprinkler heads have long been used in automatic fire extinguishing systems in order to controllably disburse a fluid to suppress or extinguish a fire in a designated area. Typically, the fluid utilized in automatic fire extinguishing systems is water, however systems have also been developed to disburse other fire extinguishing fluids. In one common design, sprinkler heads include a solid metal base with an inlet connected to a pressurized supply of water or other fire extinguishing fluid, and a deflector which alters the trajectory of the water in an optimum pattern when discharged from the base outlet orifice. In many conventional sprinkler heads the deflector is fixedly spaced from the outlet by a pair of rigid arms and mounted on a boss joining the arms. A trigger element is positioned between the deflector boss and the outlet orifice closure seal.

In another common recessed, pendant version of the sprinkler head, the deflector is movable and stored proximate to the base. A housing extends around the deflector and sprinkler body and forms a recess up into the ceiling in which the sprinkler head is located. A fluid seal, also positioned within the interior of the sprinkler head, is maintained in the closed position by a pair of pins or actuators depending below the bottom of the sprinkler head. The pins are held in an inwardly biased, or closed position by a trigger mechanism which is thermally responsive in the temperature range indicative of a fire. The trigger mechanism is commonly a thermally sensitive fusible link. Thus, under normal temperatures, the presence of the thermally sensitive fusible link prohibits fluid flow from the sprinkler head. When the temperature within the designated area rises to a preselected value due to a fire, the fusible link separates, causing the pins to move in an outward direction and thus permits downward movement of the deflector plate from the interior of the sprinkler head to a preselected distance within the interior of the designated area. The separation of the fusible link also opens the fluid seal, thereby enabling pressurized water to travel through the sprinkler head and into the designated area in order to suppress or extinguish a fire. Recessed sprinkler heads have also been conventionally supplied with a concealing cover which is frictionally fit over the downward opening of the housing. When the deflector drops it dislodges the concealing cover which falls away from the sprinkler. In an armed condition, however, the trigger mechanism is enclosed in an enclosure formed by the housing and cover.

The prior art has advanced fusible link trigger mechanisms which also function to conceal the bottom outlet of the sprinkler head. For example, U.S. Pat. No. 4,596,289 issued to Johnson discloses a combined trigger element and concealing mechanism having two complementary strut retaining members which maintain the fluid seal in a closed position. The outer surfaces of these strut retaining members are joined by a heat fusible material which is covered by a heat conductive cover. In this design, the bottom outlet of the sprinkler head is entirely enclosed by the combined trigger and concealing mechanism. In a similar design, U.S. Pat. No. 3,783,947 issued to Dix et al. advances a combined cover and trigger mechanism having a cover member which completely encloses the open portion of the bottom of the sprinkler. The cover member is attached to a lever in operational contact with a strut. This strut maintains a fluid seal in the closed position under normal temperatures. The cover member is attached to the interior surface of the sprinkler body by a heat fusible tab. When this heat fusible tab is exposed to a preselected temperature, its thermal degradation causes the release of the cover member which in turn imparts movement of the lever mechanism, and hence actuates the strut to thereby open the fluid seal.

In both of these designs, the cover mechanism entirely encloses the bottom of the sprinkler head, with the heat fusible material being located on the interior surface of the cover. When the temperature is elevated due to the presence of a fire in the designated area, the thermal energy issued from the fire is constrained to pass in an upward direction from the outer surface of the cover member towards the heat sensitive compound. Since the cover member completely encloses the bottom region of the sprinkler head, the inner surface of the cover member and the heat sensitive agent remains at ambient or near ambient conditions until thermal energy penetrates the cover member and reaches the heat sensitive agent. As a consequence of the prior art combined trigger and concealing mechanisms, the responsiveness of the sprinkler heads to which they are attached is often reduced. That is, when a fire occurs in the designated area, the temperature of the room may be at the preselected temperature at which the sprinkler head is to be actuated. However, because conduction is forced to occur in only one direction, there is a time gap between the achievement of a particular room temperature and the actuation of the sprinkler head. Delayed actuation of a sprinkler head in the presence of a fire is unacceptable because such delay may provide a sufficient time period for which the fire to spread outside of the designated area, increase property damage and the threat of injury and loss of life.

Consequently, there exists a need for a responsive and reliable combined trigger and concealing device which overcomes the difficulties encountered by the prior art.

SUMMARY OF THE INVENTION

The present invention overcomes the difficulties confronted by the prior art by providing a combined trigger and concealing device for a sprinkler head which permits heat energy to impact both the exterior and interior surface to thereby provide a more responsive and reliable trigger mechanism.

According to one aspect of the present invention, the combined trigger and concealing device includes a first plate joined in a partial overlapping relationship to a second plate by a layer of fusible material. Each of the plates is dimensioned to receive an outwardly biased actuator pin and maintain the same in an inwardly biased or closed position. The triggering device depends a preselected distance below the bottom outlet of the sprinkler head and is sized to obscure the internal components of the sprinkler from view. When positioned below the bottom of the sprinkler head, an annulus is defined between the perimeter of the first and second plates and the perimeter of the bottom of the sprinkler head. This annulus provides a fluid path, enabling transference of heat energy to the inner surface of the trigger device.

According to a preferred aspect of the invention, each plate is formed having an eccentric shape composed of a uniform radius section and a straight section. The straight section of each plate is formed with a channel. Each plate is further formed with an aperture dimensioned to receive an actuator pin depending from the sprinkler head. When assembled, the channels of the respective plates are in registration with the aperture of the opposing plate. Consequently, the outwardly biased pins impose an equal and opposite force on each of the plates. This in turn assures a timely release of the plates when a preselected temperature is experienced.

Preferably, the periphery of each plate is curved upward to form a rim. This rim collects and traps heat energy released during a fire about the inner surface of the trigger device. Accordingly, the thermally sensitive compound will degrade at a proper rate, thereby ensuring timely activation of the sprinkler head in response to a fire. The response time of the sprinkler is thus minimized while maintaining a highly aesthetic appearance. A concealed sprinkler is provided which does not require a separate cover member and thus reduces parts for manufacture and installation.

These and other advantages, benefits and objects will be understood by one skilled in the art from the drawings, description and claims which follow.

BRIEF DESCRIPTION OF THE DRAWINGS

FIG. 5 is a cross sectional view of a combined trigger and concealing device according to an alternative embodiment of the present invention shown attached to a sprinkler head; and FIG. 6 is a bottom view of the combined trigger and concealing device and sprinkler head depicted in FIG. 5.

DESCRIPTION OF THE PREFERRED EMBODIMENTS

The present invention is embodied in a unique combined trigger and concealing device for a sprinkler head 100. The present invention provides a trigger device which by its structure permits heat energy to penetrate both the interior and exterior surfaces. Exposure to thermal energy on both surfaces of the device yields a responsive trigger device which rapidly causes the actuation of the sprinkler when the temperature reaches a preselected value as a result of a fire.

Figure 1:
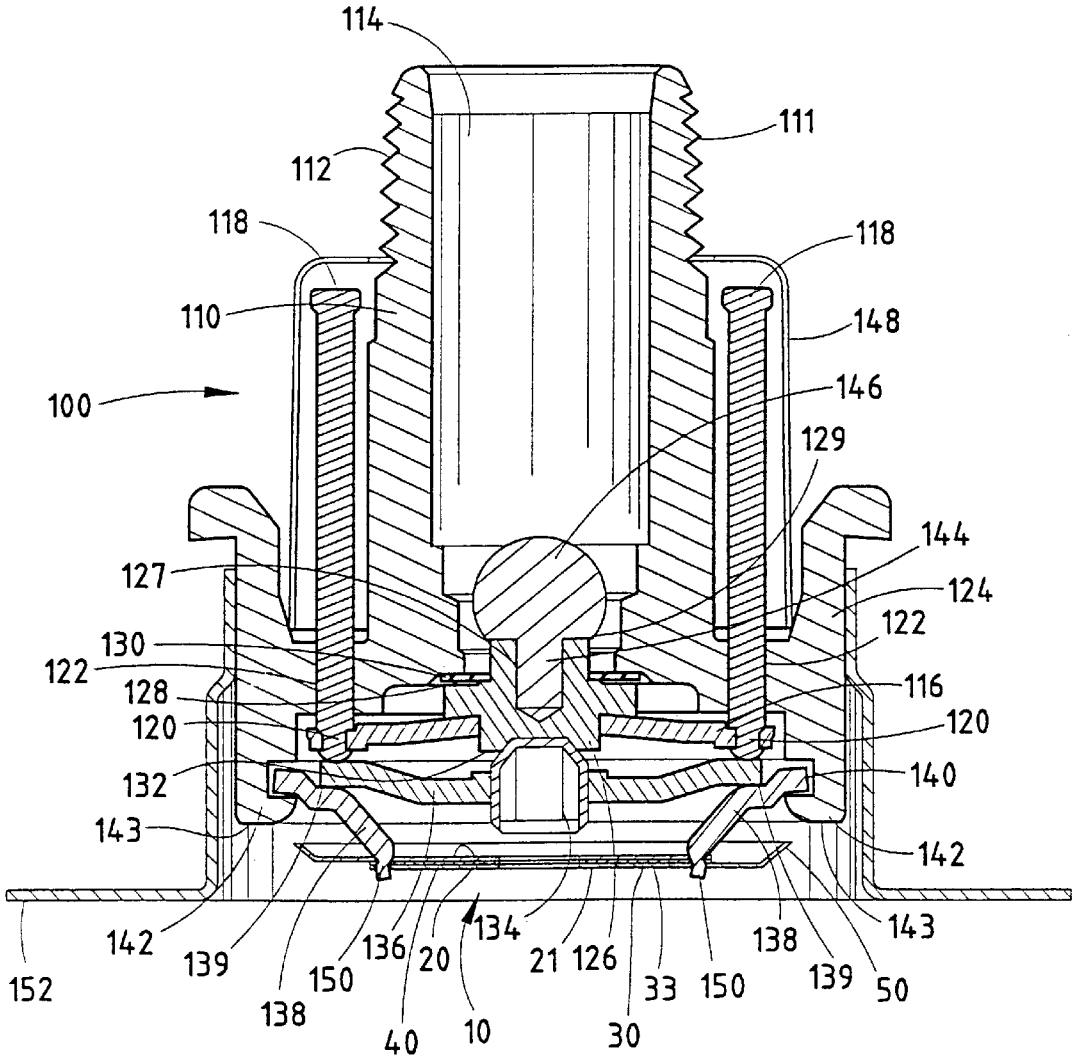
FIG. 1 is a cross sectional view of a combined trigger and concealing device according to the present invention shown attached to a sprinkler head.

Referring now to FIG. 1, an automatic sprinkler head 100 normally contains a body 110 having an upper section 112. Upper section 112 is externally threaded, allowing removable attachment with a pipe positioned within the ceiling (not shown). This pipe is in fluid communication with a source of pressurized water or other fire extinguishing fluid. Upper section 112 of body 110 is in fluid communication with the interior 114 of body 110. Disposed about the lower region of interior 114 of body 110 is a deflector 116. A pair of guide bolts 118 are positioned within apertures 120 of deflector 116 in order to be fixedly secured to deflector 116. Guide bolts 118 extend through guide holes 122 formed in rim 124 of body 110. Residing within the central bore of deflector 116 is a seal closure member 126. The top surface 128 of seal closure member 126 supports a fluid seal 130. Fluid seal 130 is in fluid communication with the interior 114 of body 110 and, when compressed against the seat of top surface 128, forms a fluid-tight seal. An adjustment plate 136 is positioned immediately below deflector 116 and seal closure member 126. An adjustment screw 134 is threaded through a central bore in adjustment plate 136 and presses upwardly against a recess in seal closure member 126. The upper ends of a pair of spring biased actuators or pins 138 are seated above a lip 140 formed about bottom region 142 of body 110. Pins 138 extend beneath adjustment plate 136 and hold plate 136 in place. Trigger device 10 prevents pins 138 from separating. With adjustment plate 136 so secured, the turning of adjustment screw 134 adjusts the closure pressure on seal closure member 126 and seal 130.

Pins 138 are biased in the outward position and depend a preselected distance below bottom region 142 of body 110. Each pin 138 has a substantially horizontal ledge 139 for supporting the periphery of adjustment plate 136. Seal closure member 126 extends a preselected distance within interior 114 of body 110 and is formed with a central recess 127 dimensioned for receipt of a rod 144 integrally attached to a spherical body 146 extending above top surface 129 of member 126 and within interior 114 of body 110. Upon activation of sprinkler head 100, the trajectory of water migrating through interior 114 is altered by spherical body 146. A shield 148 is attached to upper section 112 and rim 124 of body 110. Shield 148 encloses guide bolts 118, prohibiting wires and other materials positioned within the ceiling from interfering with the movement of guide bolts 118. Ends 150 of pins 138 are received through apertures in a combined trigger and concealing device 10, so that trigger and concealing device 10 maintains pins 138 in an inwardly biased, or closed position. An escutcheon 152 is threaded about bottom region 142 of body 110. Escutcheon 152 depends below bottom 143 of body 110 and serves to form a recess housing that conceals and closes the annulus between body 110 and the ceiling which results when sprinkler 100 is installed.

Turning now to FIGS. 2 through 6, the combined trigger and concealing device 10 of the present invention includes a first fusible plate 20 and a second fusible plate 30 joined by a heat fusible material 40. Heat fusible materials, often entitled heat sensitive materials, are generally known in the automatic sprinkler industry, and thus heat fusible material 40 may be any generally recognized material used in the art possessing the requisite degree of bonding strength and thermal sensitivity. The actual heat fusible material chosen for use with combined trigger and concealing device 10 depends upon the temperature at which activation of body 100 is desired. For example purposes only, heat sensitive material 40 may be solder or a thermally sensitive adhesive.

Each plate 20, 30 preferably has an eccentric shape defined by a section 44 having a uniform radius and a straight or linear section 46. Plates 20, 30 may be made from any conductive material commonly employed in the art. Each plate 20, 30 contains a first aperture 22, 32 dimensioned to receive a respective one of pins 138. A central hole 48, formed in each plate 20, 30, permits one to insert the proper tool therethrough, enabling the tightening or loosing of adjustment screw 134 when trigger and concealing device 10 is in the assembled position. Each plate 20, 30 is also formed with a channel 24, 34 terminating in straight section 46. As shown in FIGS. 1 through 4, the uniform radius section 44 of each plate 20, 30 is preferably formed with an upturned flange or rim 50. Alternatively, as depicted in FIGS. 5 and 6, plates 20, 30 may be substantially linear.

In assembly, aperture 22 of first plate 20 is positioned within a pin 138. Thereafter, heat fusible material 40 is adhered to bottom surface 21 of first plate 20. The other pin 138 is received by aperture 32 of second plate 30. Second plate 30 is then adhered to the it heat fusible material 40, such that channel 34 of second plate 30 is in registration with aperture 22 of first plate 20. Similarly, channel 24 of first plate 20 is in registration with aperture 32 of second plate 30. When so assembled, center hole 48 of each plate 20, 30 is in registration, thereby permitting one to insert the proper tool therethrough as necessary to tighten or loosen adjustment screw 134.

Figure 2:
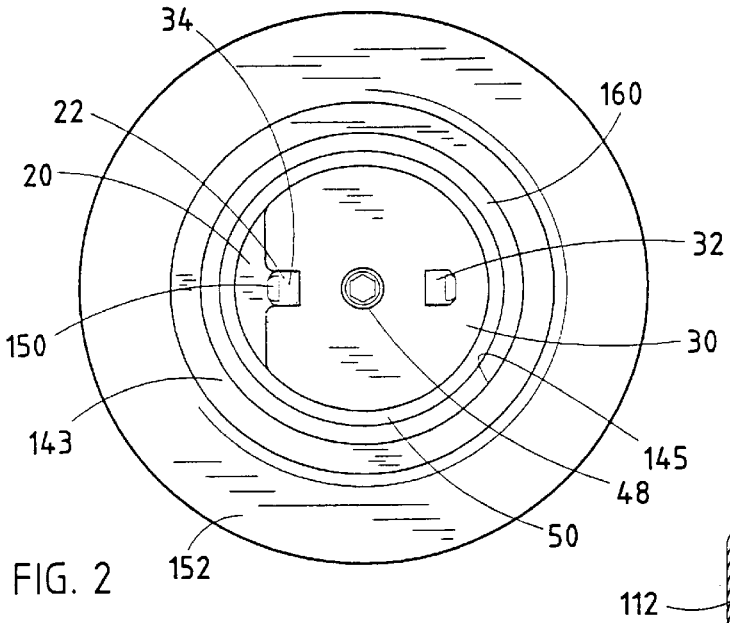
FIG. 2 is a bottom plan view of the combined trigger and concealing device and sprinkler head depicted in FIG. 1.
Figure 3:
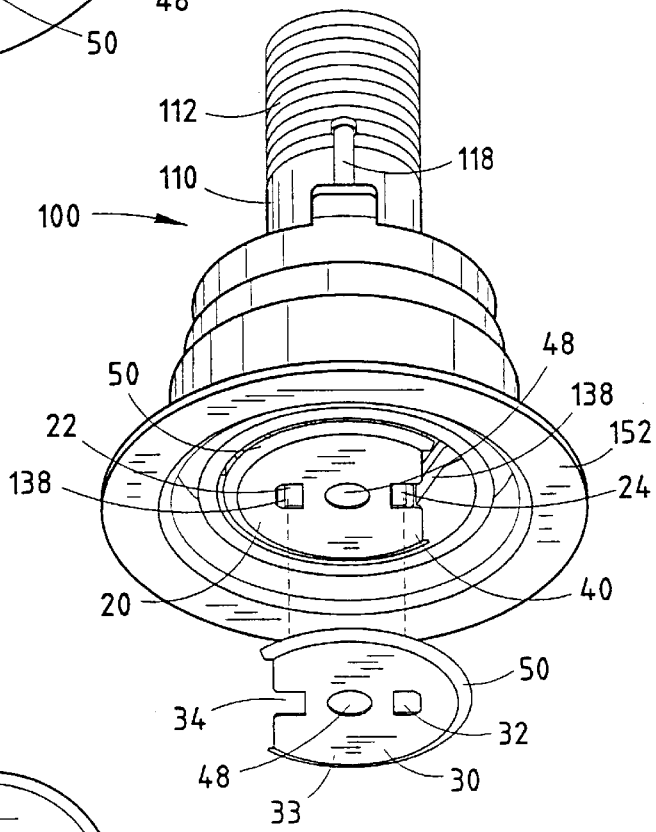
FIG. 3 is a perspective, partially exploded view of the combined trigger and concealing device and sprinkler head depicted in FIG. 1.
Figure 4:
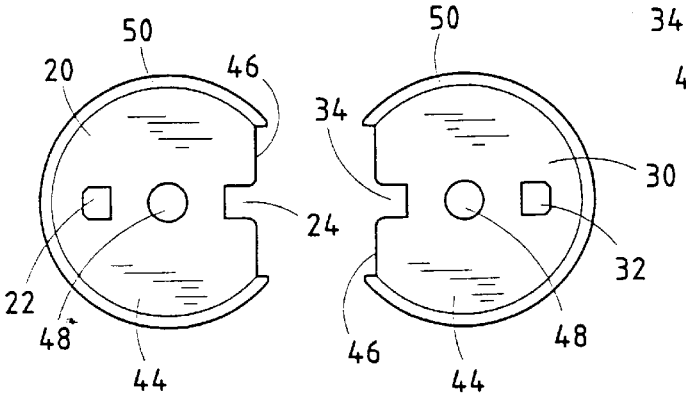
FIG. 4 is a top plan view of a first and second plate of a combined trigger and concealing device according to the invention.

As shown in FIGS. 2 and 3, when assembled, first plate 20 and second plate 30 are adhered to one another in a partially overlapping position such that straight section 46 of first plate 20 is positioned over uniform radius section 44 of second plate 30. Likewise, straight section 46 of second plate 30 is positioned over uniform radius section 44 of first plate 20. When attached to pins 138, trigger and concealing device 10 depends a preselected distance below bottom 143 of body 110 and preferably, a preselected distance above escutcheon 152. As shown in FIG. 2, trigger device 10 conceals the components of body 110 from view, and defines an annulus 160 between the periphery of trigger and concealing device 10 and inner diameter 145 of bottom 143 of body 110.

Annulus 160, defined between trigger and concealing device 10 and body 110, and placement of trigger and concealing device 10 a preselected distance below body 110 permits heat energy released from a fire to travel through annulus 160 and transfer energy to inner surface 21 of first plate 20. Moreover, rim 50, formed about uniform radius section 44 of plates 20, 30 trap heat energy in and around surface 21. As will be readily understood, heat energy also impacts outer surface 33 of second plate 30 during a fire. Conduction of heat from both its inner surface 21 and outer surface 33 enables the efficient conduction of heat to heat fusible material 40. This efficient heat conduction results in the prompt release or separation of plates 20 and 30. Consequently, the response or actuation time of sprinkler 100 is maximized.

In preferred form, plates 20, 30 of trigger and concealing device 10 form an outer dimension or diameter that is at least as great as the outer dimension of deflector 116, guide bolts 118, and adjustment plate 136. When combined plates 20, 30 are so dimensioned, trigger and concealing device 10 provides a concealing barrier that underlays and conceals the unsightly components of sprinkler head 110. In most preferred form, trigger and concealing device 10 has a diameter of approximately 1¼ inches when used for a concealed pendant sprinkler with a K value of 5.5 GPM/(√PSI) or orifice diameter of nominal ½ inches. In an armed or raised position, trigger device 10 preferably forms an annular gap of approximately 1/16 inches with bottom region 142 of body 110. Trigger device 10 is preferably positioned about ⅛ inches beneath bottom region 142 when in a raised, armed position.

Installation of body 100 is achieved by threading threaded section 111 of body 110 to the pipe (not shown) within the ceiling. Thereafter, adjustment screw 134 is rotated causing fluid seal 130 to form a completely fluid-tight seal of interior 114. A pair of aligned adjustment openings 48 in plates 20, 30 provide access to adjustment screw 134 by an appropriate tool. In operation, under ambient conditions, trigger and concealing device 10 maintains pins 138 in an inwardly biased, or closed position and thus prevents expulsion of fluid from body 110. When heat fusible material 40 is elevated to a preselected temperature due to the presence of fire, its chemical degradation or reduction in bonding strength, coupled with the force exerted on the respective plates 20, 30 by pins 138 affects the separation of first plate 20 from second plate 30. This in turn releases plate 136 causing deflector 116 to be expelled from the body 110 and depend a preselected distance within the designated area. Guide bolts 1 18 slide through guide holes 122 in order to act as arms spacing deflector 116 from the outlet orifice of body 110. Upon expulsion of deflector 116, downward movement of member 126 releases fluid seal 130, permitting water or other fire extinguishing fluid to travel through interior 114 of body 110 and be expelled therefrom. Thereafter, the water's trajectory is altered by deflector 116 in an optimum pattern to extinguish or suppress a fire.

It is to be understood that the foregoing is a description of the preferred embodiments. Those skilled in the art will recognize that variations, modifications and improvements may be made without departing from the spirit and scope of the invention disclosed herein. For example, the artisan with ordinary skill will readily understand that trigger device 10 may be used with sprinkler heads having internal components which differ from those depicted in FIGS. 1 and 5. Consequently, the scope of protection afforded the present invention is to be measured by the claims which follow in the breadth of interpretation which the law allows.

The embodiments of the invention in which an exclusive property or privilege is claimed are defined as follows:

1. A trigger device for an automatic sprinkler having a deflector positioned within the interior of a sprinkler body, wherein the sprinkler is actuated when a first and a second actuator depending below the bottom of the body are moved from a closed position to an open position, said trigger device comprising:

a first plate having a bottom surface and defining a first center aperture therethrough, said first plate defining a first actuator aperture therethrough dimensioned to receive the first actuator;

a layer of heat fusible material positioned on said bottom surface of said first plate; and a second plate having a top surface and defining a second center aperture therethrough in registration with said first center aperture, said second plate defining a second actuator aperture dimensioned to receive the second actuator, said top surface of said second plate positioned on said layer of heat fusible material when in an assembled condition with said first center aperture in registry with said second center aperture and with both said center apertures disposed between and spaced from said first actuator aperture and said second actuator aperture, said first plate and said second plate having an outer dimension, said outer dimension of said first plate and said second plate approximately at least as great as the outer dimension of the deflector so as to substantially conceal the interior of the sprinkler body.

2. The trigger device as recited in claim 1, wherein said first plate and said second plate depend a preselected distance below the bottom of the sprinkler body, thereby defining a gap between said first and said second plates and the bottom of the sprinkler body.

3. The trigger device as recited in claim 1, wherein said first plate and said second plate are formed with an upturned rim.

4. The trigger device as recited in claim 1, wherein said first plate is formed with a first channel and said second plate is formed with a second channel, wherein said first channel is in registration with said second actuator aperture formed in said second plate and said second channel is in registration with said first actuator aperture formed in said first plate.

5. An automatic sprinkler head comprising:

a sprinkler body having an inlet and an outlet, said outlet having an outer diameter;

an outlet closure element selectively blocking said sprinkler body outlet;

at least two sprinkler arms coupled to said sprinkler body;

a deflector coupled to said sprinkler arms;

an escutcheon coupled with said sprinkler body, said escutcheon having an outlet end spaced away from said sprinkler body;

said deflector having a storage position in which said escutcheon extends past said deflector to said escutcheon outlet end;

a pair of actuating pins coupled with and extending from sprinkler body;

a pair of plates joined by a fusible material, said pair of plates engaged by said actuating pins, said actuating pins selectively maintaining said outlet blocking element in an outlet blocking position, so as to form a selectively activated trigger for permitting fluid flow through said automatic sprinkler head, each plate of said pair of plates having a center aperture in registration with the center aperture of the other plate of said pair of plates, said pair of plates having an outer dimension at least as great as the outer dimension of said deflector; and wherein said escutcheon outlet end is spaced from said sprinkler body at least as far as said deflector when in said storage position whereby said plates and said escutcheon conceal said sprinkler deflector and said sprinkler body.

6. The automatic sprinkler head as recited in claim 5, wherein said top surface of said pair of plates and the bottom of the sprinkler body define a gap therebetween to thereby provide passage of air to said top surface of said pair of plates.

7. The automatic sprinkler head as recited in claim 5, wherein each plate of said pair of plates is formed with an upturned rim.

8. The automatic sprinkler head as recited in claim 5, wherein said pair of actuating pins is a first actuating pin and a second actuating pin, and wherein said pair of plates further comprises:

a first plate having a first aperture formed therethrough, said first aperture dimensioned to receive said first actuating pin; and a second plate having a second aperture formed therethrough, said second aperture dimensioned to receive said second actuating pin.

9. The automatic sprinkler head as recited in claim 8, wherein said first plate further comprises a first channel and said second plate further comprises a second channel, wherein said first channel of said first plate is in registration with said second aperture of said second plate, and said second channel of said second plate is in registration with said first aperture of said first plate.

10. The automatic sprinkler head as recited in claim 8, wherein said first plate and said second plate are formed having an eccentric shape.

11. The automatic sprinkler head as recited in claim 8, wherein said first plate is formed having a section having a uniform radius and a straight section, and said second plate is formed having a section having a uniform radius and a straight section.

12. The automatic sprinkler head as recited in claim 11, wherein said first plate is formed with a first channel extending from said straight section, and said second plate is formed with a second channel extending from said straight section, wherein said first channel is in registration with said second aperture in said second plate, and wherein said second channel is in registration with said first aperture in said first plate.

13. A trigger device for an automatic sprinkler having a sprinkler assembly coupled with a sprinkler body, a first actuating pin depending below the bottom of the sprinkler body and a second actuating pin depending below the bottom of the sprinkler body, said trigger device comprising:

a first plate shaped to define at least a portion of a circle and having a first aperture formed therethrough and a first channel, said first channel opening to a side of said first plate and extending linearly toward the center of said first plate, said first aperture dimensioned to receive the first actuating pin, said first plate formed having a section having a uniform radius and a straight section;

a second plate shaped to define at least a portion of a circle and having a second aperture formed therethrough and a second channel, said second channel opening to a side of said second plate and extending linearly toward the center of said first plate, said second aperture dimensioned to receive the second actuating pin, said second plate formed having a section having a uniform radius and a straight section;

a layer of fusible material joining said first plate and said second plate in an assembled condition with said first plate and said second plate cooperatively forming a circular member and said first channel diametrically aligned with said second channel; and wherein said first plate and said second plate in said assembled condition provide a diameter so as to substantially conceal the sprinkler body, and wherein said first channel of said first plate is in registration with said second aperture of said second plate, and said second channel of said second plate is in registration with said first aperture of said first plate, wherein said first channel extends from said straight section of said first plate, and said second channel extends from said straight section of said second plate, and wherein said first plate and said second plate are formed with a center hole, said center hole of said first plate being in registration with said center hole of said second plate.

14. An automatic sprinkler head comprising:

a sprinkler body having an interior and a bottom, said bottom having an inner diameter;

a sprinkler assembly coupled to said sprinkler body, said sprinkler assembly having a deflector, and an adjustment screw positioned below said deflector;

a pair of actuators in operational connection with said sprinkler assembly, said pair of actuators depending below said bottom of said sprinkler body, said pair of actuators movable from a closed position wherein said automatic sprinkler is inactive to an open position wherein said automatic sprinkler is activated;

a first plate having a bottom surface and a first center hole, said first plate receiving an actuator of said pair of actuators;

a layer of heat fusible material positioned on said bottom surface of said first plate; and a second plate having a top surface and a second center hole in registration with said first center hole enabling a tool to pass through said first center hole and said second center hole and engage said adjustment screw, said top surface of said second plate positioned against said layer of heat fusible material, said second plate receiving the other actuator of said pair of actuators, said first plate and said second plate having an outer dimension, said outer dimension of said first and said second plate approximately at least as great as the outer dimension of said deflector so as to substantially conceal said interior of said sprinkler body.

15. An automatic sprinkler head comprising:

a sprinkler body having an inlet and a outlet, said outlet having an outer diameter;

a sprinkler assembly coupled to said sprinkler body, said sprinkler assembly having a deflector with a deflector diameter, and an adjustment screw positioned below said deflector and operatively coupled to said deflector to selectively adjust the position thereof;

a pair of actuators in operational connection with said sprinkler assembly, said pair of actuators depending below said bottom of said sprinkler body, said pair of actuators movable from a closed position wherein said automatic sprinkler is inactive to an open position wherein said automatic sprinkler is activated;

a first plate having a bottom surface and a first center aperture, said first plate receiving an actuator of said pair of actuators;

a layer of heat fusible material positioned on said bottom surface of said first plate; and a second plate having a top surface and a second center aperture in registration with said first center aperture when in an assembled condition to enable an adjustment tool to pass through said first center aperture and said second center aperture and engage said adjustment screw, said top surface of said second plate positioned against said layer of heat fusible material, said second plate receiving the other actuator of said pair of actuators, said first plate and said second plate cooperatively defining a generally circular shape having an outer diameter, said outer diameter of said first and said second plate approximately at least as great as said deflector diameter so as to substantially conceal said sprinkler body and provide access for an adjustment tool to said adjustment screw.

16. The automatic sprinkler head as recited in claim 15, wherein said first plate is formed with a first actuator aperture dimensioned to receive an actuator of said pair of actuators.

17. The automatic sprinkler head as recited in claim 16, wherein said second plate is formed with a second actuator aperture dimensioned to an actuator of said pair of actuators.

18. The automatic sprinkler head as recited in claim 17, wherein said first plate is formed with a first channel, said second plate formed with a second channel, said first channel positioned in registration with said second actuator aperture and said second channel positioned in registration with said first actuator aperture.

19. The automatic sprinkler head as recited in claim 15, wherein said first plate and said second plate depend a preselected distance below said bottom of said sprinkler body thereby defining a gap between said first plate and said second plate and said bottom of said sprinkler body.

20. The automatic sprinkler head as recited in claim 19, wherein said first plate and said second plate are formed with an upturned rim.

21. A trigger device for an automatic sprinkler having a sprinkler assembly positioned within the interior of a sprinkler body, a first actuating pin depending below the bottom of the sprinkler body and a second actuating pin depending below the bottom of the sprinkler body, said trigger device comprising:

a first plate having a first aperture formed therethrough and a first channel, said first aperture dimensioned to receive the first actuating pin;

a second plate having a second aperture formed therethrough and a second channel, said second aperture dimensioned to receive the second actuating pin;

a layer of fusible material joining said first plate and said second plate in an assembled condition; and wherein said first plate and said second plate substantially conceal the interior of the sprinkler body, and wherein said first channel of said first plate is in registration with said second aperture of said second plate, and said second channel of said second plate is in registration with said first aperture of said first plate.

22. An automatic sprinkler head comprising:

a sprinkler body having an interior and a bottom, said bottom having an inner diameter;

a sprinkler assembly coupled to said sprinkler body;

an escutcheon coupled to said sprinkler body and depending below said bottom of said sprinkler body;

a pair of actuating pins depending below said bottom of said sprinkler body;

a pair of plates joined by a fusible material, said pair of plates positioned a preselected distance above said escutcheon, said pair of plates receiving the pair of actuating pins, each plate of said pair of plates having a center aperture in registration with the center aperture of the other plate of said pair of plates, said pair of plates defining a top surface, wherein said pair of plates substantially conceal the interior of the sprinkler body.

23. A trigger device for an automatic sprinkler having a deflector coupled with a sprinkler body, wherein the sprinkler is actuated when a first and a second actuator depending below the bottom of the body are moved from a closed position to an open position, said trigger device comprising:

a first plate having a bottom surface and an upturned rim, said first plate receiving the first actuator;

a layer of heat fusible material positioned on said bottom surface of said first plate; and a second plate having a top surface and an upturned rim, said top surface of said second plate positioned against said layer of heat fusible material, said first plate and said second plate having an outer dimension, said outer dimension of said first plate and said second plate approximately at least as great as the outer dimension of the deflector so as to substantially conceal the interior of the sprinkler body.

24. The trigger device as recited in claim 23, wherein said first plate is formed with an aperture dimensioned to receive the first actuator, and said second plate is formed with an aperture dimensioned to receive the second actuator.

25. The trigger device as recited in claim 24, wherein said first plate is formed with a first channel, and said second plate is formed with a second channel, wherein said first channel is in registration with said second aperture, and said second channel is in registration with said first aperture.

26. The trigger device as recited in claim 23, wherein said first plate is formed having a section having a uniform radius and a straight section, and said second plate is formed having a section having a uniform radius and a straight section.

27. An automatic sprinkler assembly comprising: a sprinkler body; a deflector slidably coupled to said sprinkler body and having a retracted position and an extended position; a first actuating pin depending below the bottom of said sprinkler body and said deflector in said retracted position; a second actuating pin depending below the bottom of said sprinkler body and said deflector in said retracted position; a trigger device positioned beneath said sprinkler body comprising a first plate shaped to define at least a portion of a circle and having a first aperture formed therethrough and a first channel, said first channel opening to a side of said first plate and extending linearly toward the center of said first plate, said first aperture dimensioned to receive the first actuating pin, a second plate shaped to define at least a portion of a circle and having a second aperture formed therethrough and a second channel, said second channel opening to a side of said second plate and extending linearly toward the center of said first plate, said second aperture dimensioned to receive the second actuating pin, a layer of fusible material joining said first plate and said second plate in an assembled condition with said first plate and said second plate cooperatively forming a circular member and said first channel diametrically aligned with said second channel, wherein said first plate and said second plate in said assembled condition provide a diameter so as to substantially conceal the sprinkler body, and wherein said first channel of said first plate is in registration with said second aperture of said second plate, and said second channel of said second plate is in registration with said first aperture of said first plate;

an escutcheon coupled with said sprinkler body, said escutcheon having an escutcheon outlet end spaced from said sprinkler body at least as far as said trigger device, whereby said plates of said trigger device and said escutcheon conceal said deflector and said sprinkler body.

28. The automatic sprinkler assembly as recited in claim 27, wherein said first plate is formed having a section having a uniform radius and a straight section, and said second plate is formed having a section having a uniform radius and a straight section.

29. The automatic sprinkler assembly as recited in claim 28, wherein said first channel extends from said straight section of said first plate, and said second channel extends from said straight section of said second plate.

30. The automatic sprinkler assembly as recited in claim 27, wherein said first plate and said second plate are formed with an upturned rim.

31. The automatic sprinkler assembly as recited in claim 27, wherein said first plate and said second plate are formed having an eccentric shape.

32. The automatic sprinkler assembly as recited in claim 27, wherein said first plate and said second plate define a top surface, wherein said top surface and the bottom of the sprinkler body define a gap therebetween.

* * * * *